US008104130B2

(12) United States Patent
Lerner et al.

(10) Patent No.: US 8,104,130 B2
(45) Date of Patent: Jan. 31, 2012

(54) BRIDGE STRUCTURE

(76) Inventors: Marc Lerner, Swan Lake, NY (US); Steven Lerner, Swan Lake, NY (US); Barbara Lerner, Swan Lake, NY (US); Jerrold Lerner, Swan Lake, NY (US)

( * ) Notice: Subject to any disclaimer, the term of this patent is extended or adjusted under 35 U.S.C. 154(b) by 253 days.

(21) Appl. No.: 12/284,967

(22) Filed: Sep. 26, 2008

(65) Prior Publication Data

US 2010/0043153 A1 Feb. 25, 2010

Related U.S. Application Data

(60) Provisional application No. 60/995,548, filed on Sep. 27, 2007.

(51) Int. Cl.
*E01D 2/00* (2006.01)
*E01D 6/00* (2006.01)
*E01D 19/00* (2006.01)

(52) U.S. Cl. ..... 14/74.5; 14/6; 14/13

(58) Field of Classification Search ..... 14/3, 6, 14/13, 74.5, 76

See application file for complete search history.

(56) References Cited

U.S. PATENT DOCUMENTS

| | | | | | |
|---|---|---|---|---|---|
| 60,205 | A | * | 12/1866 | Leopold | 14/74.5 |
| 795,899 | A | * | 8/1905 | Cunningham | 52/174 |
| 1,984,567 | A | * | 12/1934 | Briggs | 52/340 |
| 2,931,467 | A | | 3/1963 | Fentiman | |
| 3,157,731 | A | | 11/1964 | Torr | |
| 3,192,669 | A | | 7/1965 | Hawkins | |
| 3,691,576 | A | * | 9/1972 | Miles et al. | 14/72.5 |
| 3,789,687 | A | | 2/1974 | Cutter | |
| 4,300,320 | A | * | 11/1981 | Rooney | 14/73 |
| 4,353,662 | A | | 10/1982 | DuChateau | |
| 4,355,918 | A | | 10/1982 | Van Vliet | |
| 4,604,841 | A | * | 8/1986 | Barnoff et al. | 52/174 |
| 4,912,795 | A | * | 4/1990 | Johnson | 14/3 |
| 5,487,199 | A | * | 1/1996 | Nelson | 14/74.5 |
| 6,055,693 | A | * | 5/2000 | Lehr et al. | 14/73 |
| 6,073,293 | A | * | 6/2000 | Ahlskog et al. | 14/73 |
| 6,081,955 | A | * | 7/2000 | Dumlao et al. | 14/73 |
| 6,308,357 | B1 | * | 10/2001 | Maier et al. | 14/13 |
| 6,401,286 | B1 | * | 6/2002 | Brenn | 14/73 |
| 7,069,614 | B1 | * | 7/2006 | Sivachenko et al. | 14/73 |

* cited by examiner

*Primary Examiner* — Thomas Will
*Assistant Examiner* — Abigail A Risic
(74) *Attorney, Agent, or Firm* — Alfred M. Walker

(57) ABSTRACT

A bridge supports any desired loading capacity to cross rivers, ravines, highways, wetlands, and other areas where traffic or pedestrians conveniently access the opposite side. The structure is assembled in a number of ways at the bridge site, using smaller equipment and less time than is normally required. The prefabricated and trial fitted elements can be assembled at ground level and the structure can be launched on rollers across the area that is to be crossed, or can be assembled sequentially from one or both sides. The structure includes two or more box girders supporting the bridge deck which is integrated into the structure. The upper portion of the girders form the side barriers of the bridge and the deck with integrated cross members is fastened to the lower portion of the girders, both of which are sized to accommodate the load bearing capacity of the traffic using the structure.

17 Claims, 7 Drawing Sheets

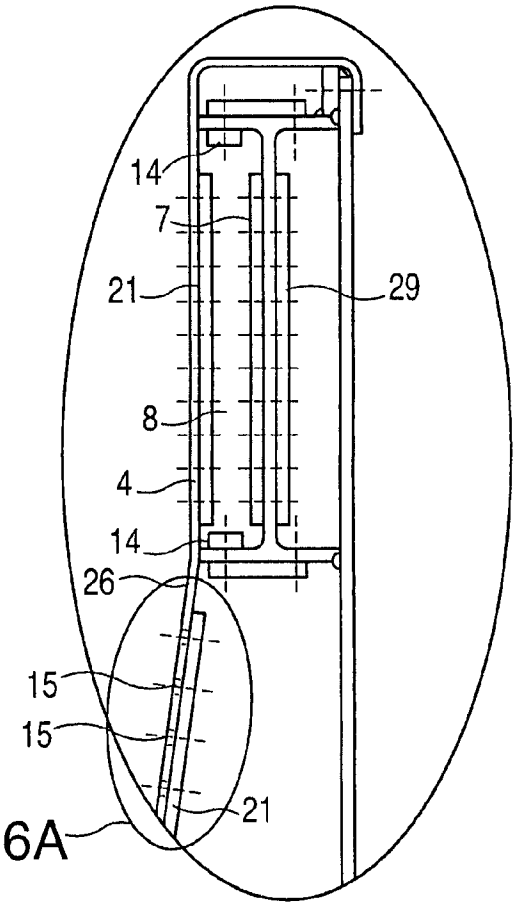
FIG. 6A
FIG. 4
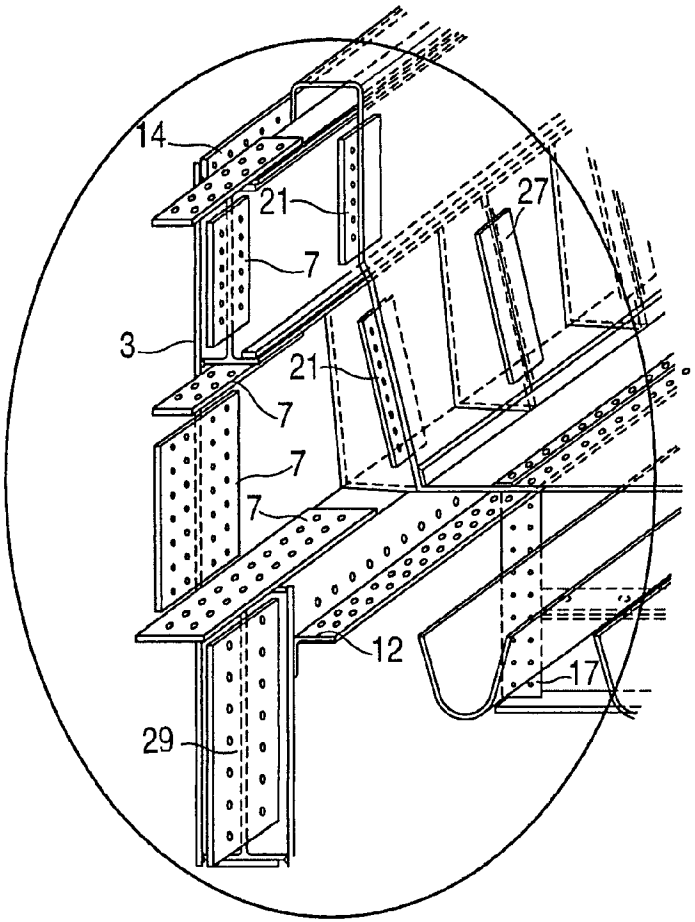
FIG. 9

BRIDGE STRUCTURE

RELATED APPLICATIONS

This application is based upon provisional application No. 60/995,548, filed Sep. 27, 2007, which application is incorporated by reference herein. Applicant claims benefit under 35 U.S.C. §119(e) therefrom.

FIELD OF THE INVENTION

The present invention relates to short to medium span bridges across highways and other crossing requirements such as rivers, railroads, ravines, and wetlands. As designed, these bridges are totally prefabricated in the factory and preassembled to the greatest extent possible to ensure the proper fit of all of the elements which make up the completed bridge structure. This is done to speed up the erection time and to minimize or eliminate any costly and time consuming field labor.

There are many types of prefabricated bridges available from various manufacturers today. Most of these are used as temporary structures which can be erected quickly to be used while a permanent bridge structure is built and then disassembled and removed from the site. This extra work and time consumed is both costly and an inconvenience to the users of the bridge structure. The truss designs of these temporary bridges are not particularly appealing and the loads they are capable of supporting are generally less than that which is required for a permanent bridge structure.

OBJECTS OF THE INVENTION

It is therefore an object of this invention to provide a prefabricated bridge structure which can support the heaviest traffic loads that are required.

It is another object of this invention to provide a prefabricated bridge structure which can be assembled at the bridge site quickly, with a minimum number of elements which have been previously assembled where manufactured and then disassembled and shipped to the permanent site for rapid assembly into the finished bridge structure.

It is a further object of this invention to provide a prefabricated bridge structure that will last for a long period of time without being affected by weather or temperature conditions and require a minimum of maintenance.

Yet another object of this invention is to limit the number of bolted members which are the primary cause of bridge failures due to the flexing of the attachment points of the members, when subjected to the varying and cyclical loading of these areas by the traffic moving across the structure.

It is also an object of this invention to design a bridge structure completely out of metal and other flexible materials which can yield and then return to their original position without cracking or becoming permanently deformed.

Still another object of this invention is to provide a structure that has no areas that are difficult to paint or maintain in order to limit the possibility of corrosion of the metal portions of the structure.

A further object of this invention is to protect the inaccessible interior areas of the bridge structure from corrosion by completely sealing those areas or filling them with foam to eliminate the entrance of oxygen in the air which is the primary cause of corrosion in these inaccessible metal areas.

An additional object of this invention is to provide a bridge structure in which all of the elements work together to give the finished structure the strength and rigidity to satisfy all of the conditions to which the bridge will be subjected.

Yet another object of this invention is to provide a bridge structure in which the bridge barriers work in composite with the deck and substructure to form the box girders necessary to support the imposed loads to which the bridge will be subjected.

There are many other objectives to which this invention can be applied such as erection and launching from one or both sides of the area that is to be crossed, combining bridge spans parallel to one another to provide additional lanes to create multiple lane two way traffic bridges, sequential launching of bridge segments from portions of the structure that have already been erected to build long causeways over swampy or shallow water areas where there might be difficulty in placing or supporting heavy construction equipment, and many others that are too numerous to mention.

SUMMARY OF THE INVENTION

The bridge of this invention includes girders composed of upper and lower girder chords connected together by side plates and diaphragms to form a boxed girder with its upper portion shaped like a partially sloped highway barrier. Deck support beams are attached between the lower chords of the girders to support the orthotropic deck panels, which are fastened to the top of the cross beams. The orthotropic deck panels form a bridge deck made of steel or aluminum plates supported by ribs, such as undulating arcuate ribs, underneath. The panels are also attached to the lower portion of the barrier shaped inner panels of the girders. These orthotropic deck panels become the riding surface of the bridge and serve as a horizontal diaphragm to accommodate the horizontal forces to which the bridge will be subjected. The lower portion of the inner barrier panel can be made out of stainless steel to avoid corrosion in this area due to the scraping of the painted surface by snowplows and the wheels of vehicles which rub against these areas. From a practical point of view, this bridge design is best suited for two or three lane traffic. If more than two or three traffic lanes are required, a center divider girder can be made with both upper adjacent sides having the shape of a highway barrier. This enables the doubling of the width of the bridge and provide a separation for the traffic which is moving in opposite directions. The orthotropic panels have a temporary riding surface applied in the place where they are manufactured, which becomes the base on which the permanent macadam riding surface is applied in the field when all of the work is completed.

To summarize, the bridge is made of two side girders made up of upper and lower chords, which have stiffeners and diaphragms welded between them. Plate metal skins are fastened to the girders to form a box girder, the upper portion of which is in the shape of a highway barrier having sloped lower mid portion, forming a trapezoid when viewed in cross section, attached to a vertical upper portion, forming a rectangle when viewed in cross section. The metal may be steel, carbon steel, aluminum or other suitable materials. Cross beams are attached to web stiffeners which are fastened between the flanges and web of the lower girder chords and protrude through the inside cover plate of the lower chord to provide a connection point for the cross beams. Orthotropic deck panels are placed on top of these cross beams and fastened to the cross beams and to an angle which is welded to the upper portion of the lower inside girder chord cover panel and to each other to create a continuous horizontal diaphragm which is also connected to the girder.

The structure thus created essentially becomes a horizontal beam with the girders acting as flanges and the deck acting as the web. The girders, which are connected together by the orthotropic deck, have the weight carrying capacity to accommodate the vehicular traffic that will be traveling across the bridge.

In the case where longer spans are required, which requires deeper side girders, reinforced openings can be cut into the web of the upper girder top chord and the inner and outer skins above the level of the highway barrier to create a less confining atmosphere for the drivers and occupants of the vehicles using the bridge.

BRIEF DESCRIPTION OF THE DRAWINGS

The present invention can best be understood in conjunction with the accompanying drawings. It should be noted that the invention is not limited to the precise embodiments shown on the drawings, in which:

FIG. 4, shown in the detail viewing ellipse of FIG. 1, is a detail of the upper portion of the removable inside access face plate which is attached to a vertically extending tapped bar welded to the top edge of the upper chord of the side box girder of the bridge and to tapped bars welded to the two adjacent box girder diaphragms at the place where a splice of the bridge sections is desired.

FIG. 6A is a detail cross sectional view of a detail of FIG. 6.

FIG. 8B is a mirror image cross sectional view of the cover plate 23 with the tapped edge bar 24 shown in FIG. 8A;

DETAILED DESCRIPTION OF THE DRAWINGS

Figure 1:
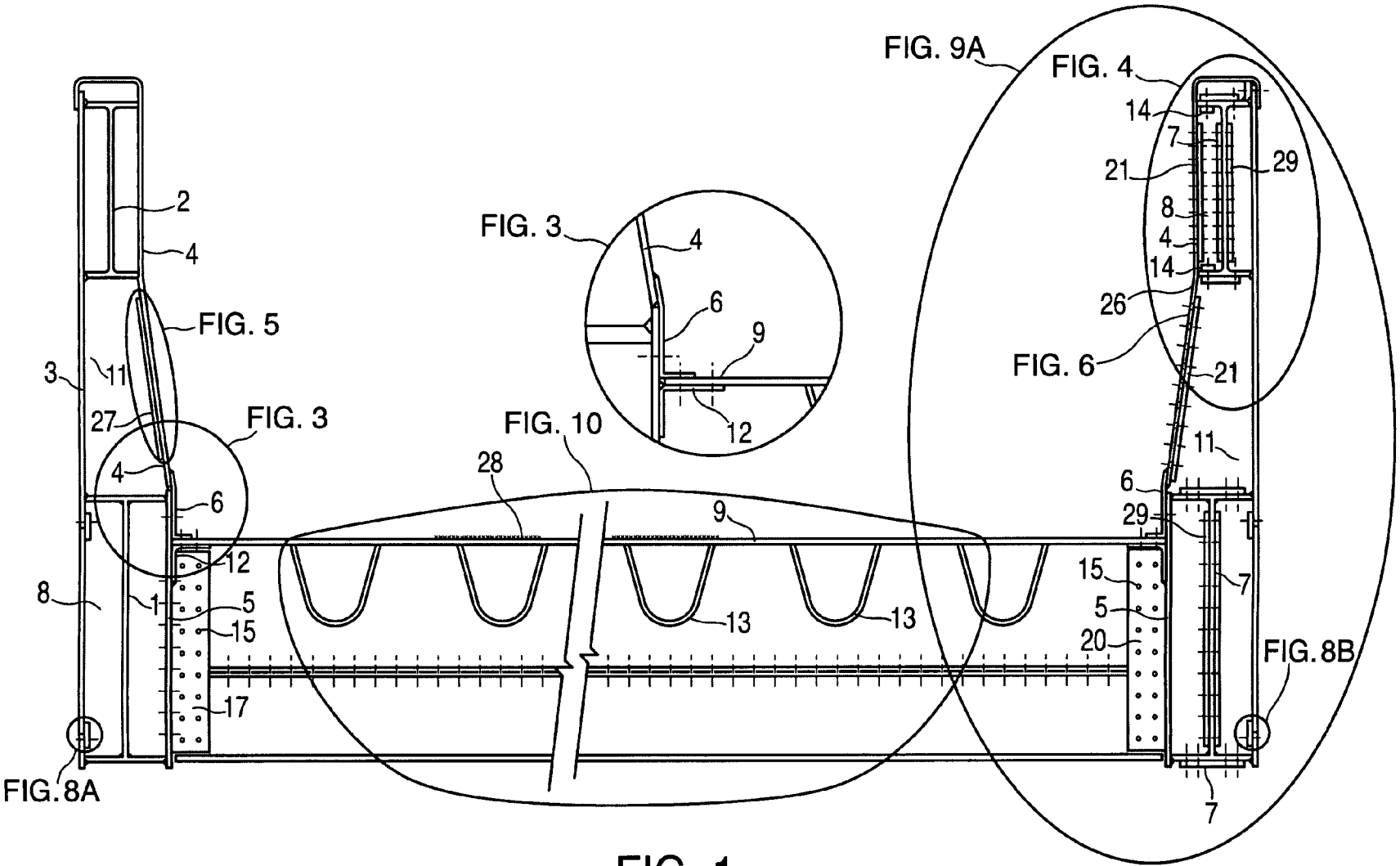
FIG. 1 is a cross sectional schematic of the invention illustrating the various elements in their combined form which make up the structure of the bridge. The sizes of the elements may vary from one structure to another to enable the engineer or designer of the bridge to adapt or combine these elements to suit the requirements for the structure, such as length, width, load bearing capacity, and other factors that have to be considered to accomplish the desired bridge design.

FIG. 1 shows a cross section of the invention with the details of the position of the elements that make up the bridge structure of the invention. For example, FIG. 1 shows the bridge structure of this invention which includes girders composed of an upper girder chord having an upper chord beam 2 and a lower girder chord having a lower chord beam 1, connected together by outer side plate 3 and inner side plate 4 and diaphragms 11 to form a boxed girder with its upper portion shaped like a partially sloped highway barrier having an upper part shaped like a rectangle in cross section attached to a lower sloping part shaped like a trapezoid in cross section. Deck support beams are attached between the lower chords of the girders to support the orthotropic deck panels, which are fastened to the top of the cross beams. The orthotropic deck panels form a bridge deck made of steel or aluminum plates 9 supported by deck support ribs 13 underneath. The panels are also attached to the inner lower chord cover plates 5 of the lower portion of the barrier shaped inner panels of the girders. These orthotropic deck panels formed by plates 9 and ribs 13 become the riding surface of the bridge and serve as a horizontal diaphragm to accommodate the horizontal forces to which the bridge will be subjected. The lower portion of the inner barrier panel, such as, for example, projecting corner angle members 6, can be made out of stainless steel to avoid corrosion in this area due to the scraping of the painted surface by snowplows and the wheels of vehicles which rub against these areas.

Figure 2:
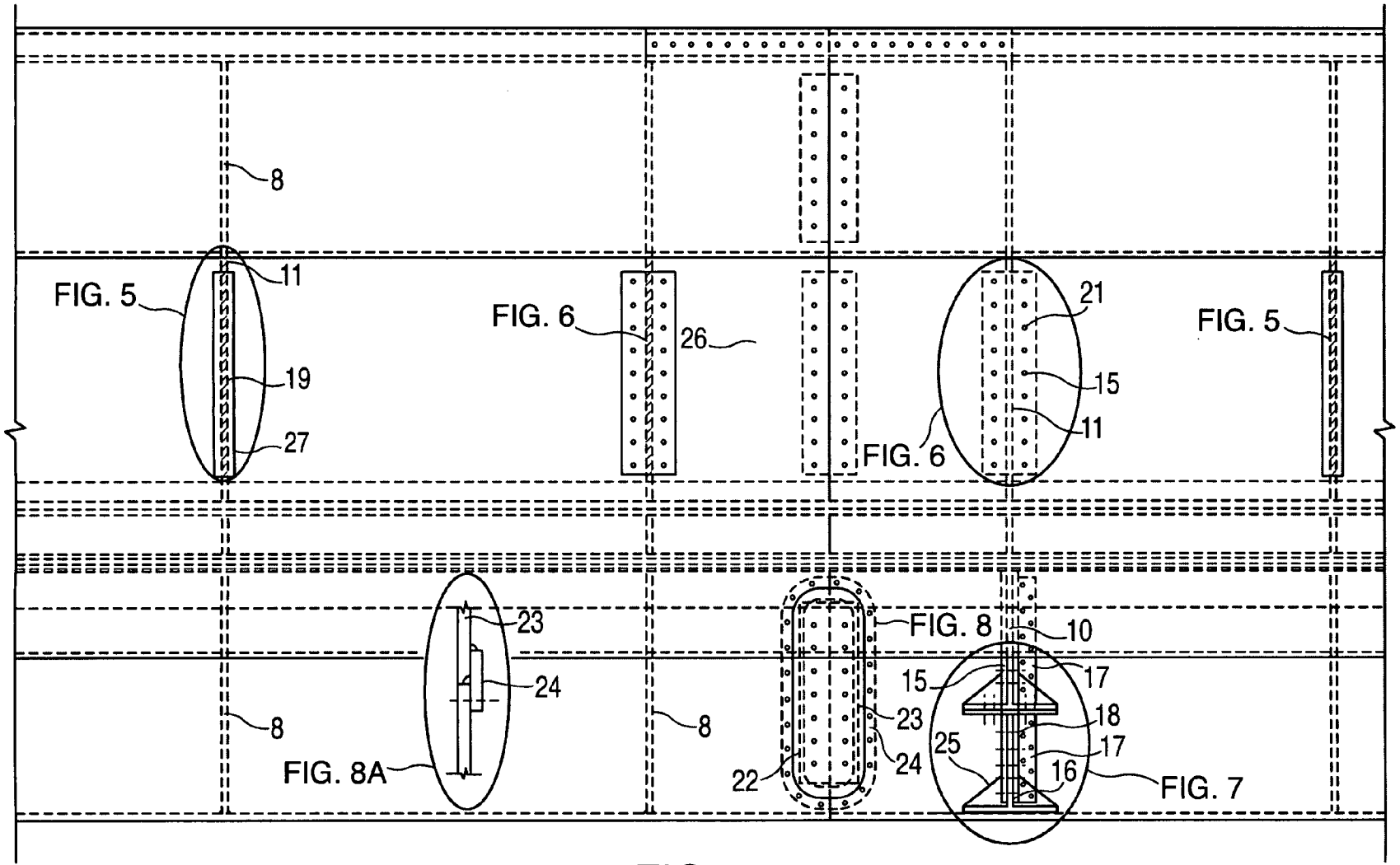
FIG. 2 is a longitudinal section of a portion of the bridge illustrating the various elements in the combined form which make up the structure of the bridge.
Figure 7:
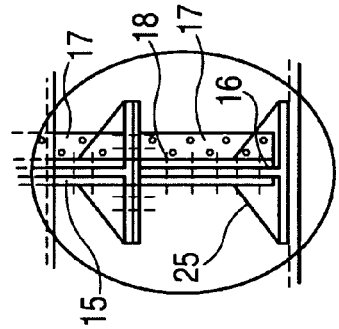
FIG. 7, shown in the detail viewing ellipse of FIG. 2, is a cross sectional view of the connection between the cross beams/floor beams and the protruding web stiffeners, using angles which have holes matching those in the lower beam web stiffener extensions and which are bolted to the lower beam cover plate, thus forming knife connections for the attachment of floor beams and the diaphragms of the deck plate assemblies.

FIG. 2 is a longitudinal view of the invention with the position of the diaphragms 11 and web stiffeners 8, as well as in FIG. 7 (in the detail ellipse labeled FIG. 7 of FIG. 2), showing the bolting 18 to the cross beams 16 and the deck cross beam diaphragm 10.

Figure 3:
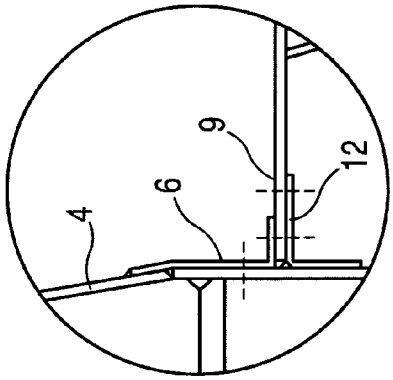
FIG. 3, shown in the circular detail viewing circle of FIG. 1, is a detail of the stainless steel edge guard which is attached to the lower edge of the inside face of the lower sloped barrier portion of the side girder where it connects to the deck plate and to the continuous deck support angles, also known as projecting corners.

FIG. 3 is a detail of the stainless steel snow plow paint protection corner angle 6 and its connection to the horizontal deck plate 9, the inside lower chord cover plate 5, the deck support corner angle 12, and the inside face plate 4 of the box girder with the stainless steel corner angle 6.

FIG. 4 is a detail of the connection of the partially sloping inner box girder cover plate 26 having a distal projecting retaining lug with a grasping tab portion reaching over and attached to an upper distal end of the outer girder backplate 3 and the tapped bar 14, which is welded to the edge of the horizontally extending top flange of the upper chord beam 2 of the upper chord of the girder 2, or shop welded directly to the backplate 3.

Figure 5:
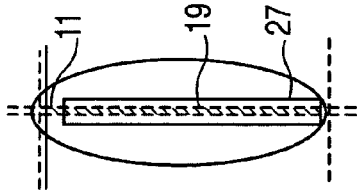
FIG. 5, shown in the detail viewing ellipse of FIG. 2, is a detail of the attachment of the diaphragm or web stiffener edge bars to the inside girder face plates by plug welding the protruding edge bar of the diaphragm or web stiffener through slots cut into the inside girder face plates.

FIG. 5 is a detail of one method of securing the inner cover plate 4 to the diaphragms 11 via slots 19 cut into the cover plate 4 at the diaphragm 11 locations and plug welding the diaphragm to the cover plate 4 through the slots 19.

Figure 6:
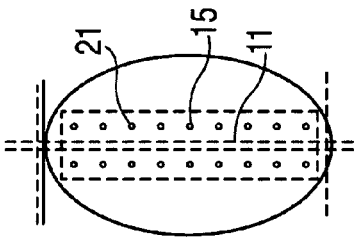
FIG. 6, shown in the detail viewing ellipse of FIG. 2, is an alternate detail to the bolted connected means of FIG. 5 for attaching the edge of the diaphragms to the inside face cover plate of the side box girders, by welding a tapped bar onto the edge of the diaphragm or web stiffener and fastening both members together with appropriate sized fasteners.

FIG. 6 shows a method of securing the diaphragms to the inside girder access cover plate 26 by welding a tapped bar onto the edge of the diaphragm which is to be used to attach the diaphragm to the inside girder access cover plate 26, through matching holes drilled into the cover plate 26.

FIG. 6A is a detail cross sectional view of a detail of FIG. 6.

Figures 6B, 9, 11:
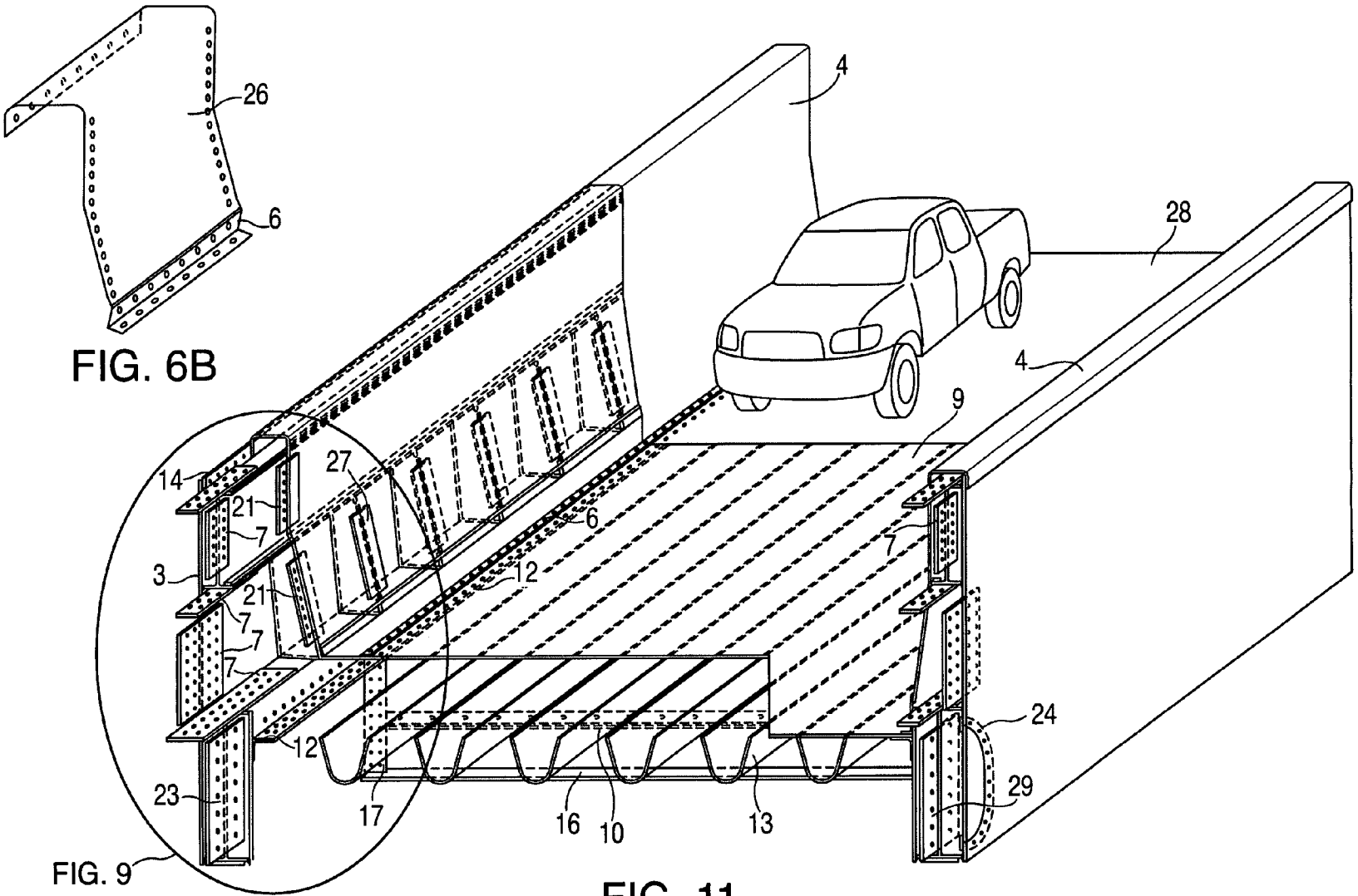
FIG. 6B is an isometric view of the a portion of the upper cover plate.
FIG. 9, shown in the detail viewing ellipse of FIG. 11, is an isometric view of the assembly of the elements and the method of connecting two of the box girder sections together before the cover plate shown in FIG. 6 is secured in place.
FIG. 11 is an isometric view of an assembled bridge section with a schematic view of the elements used to connect two bridge sections together.

FIG. 6B is an isometric view of a portion of the upper cover plate 26.

FIG. 7 is a detail of the protruding web stiffener extension plates 20 that connect the cross beam 16 and the deck panel diaphragm 10 to the side box girder shown in FIG. 9 and to the knife connection corner angle 17. It also illustrates the sloped epoxy concrete region 25 or other suitable material that is placed on top of the crossbeam flanges, which prevents birds from standing or nesting in those areas and greatly reduces the incidence of corrosion that their excrement is responsible for.

Figure 8A:
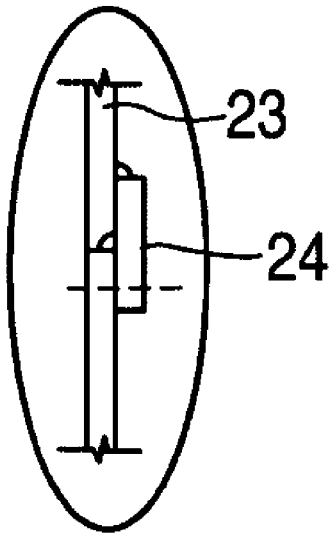
FIG. 8A is a cross sectional view of the cover plate with the tapped edge bar of the detail view of FIG. 8.
Figure 8:
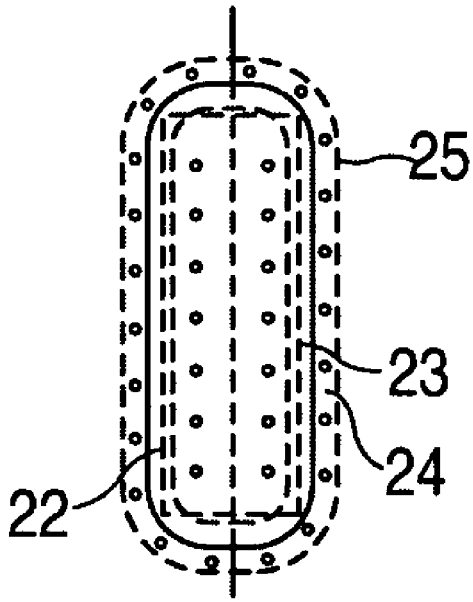
FIG. 8, shown in the detail viewing circle of FIG. 1, is a front cross sectional view of the cover plate connection for the opening needed to access the lower chords of the side box girders to facilitate the splice plate bolting of the lower beams together needed to assemble the bridge.

FIG. 8 is a detail of the cover plate 23 with the tapped edge bar 24 welded to its periphery 23 that covers the opening 22 for the access required for bolting the lower chord beam 1 and splice plates 7 shown in FIGS. 1 and 9.

FIG. 8A is a cross sectional view of the cover plate 23 with the tapped edge bar 24 of the detail view of FIG. 8.

FIG. 9 is an isometric view of the assembly of FIG. 4, FIG. 5, FIG. 6, FIG. 7, and FIG. 8.

Figure 9A:
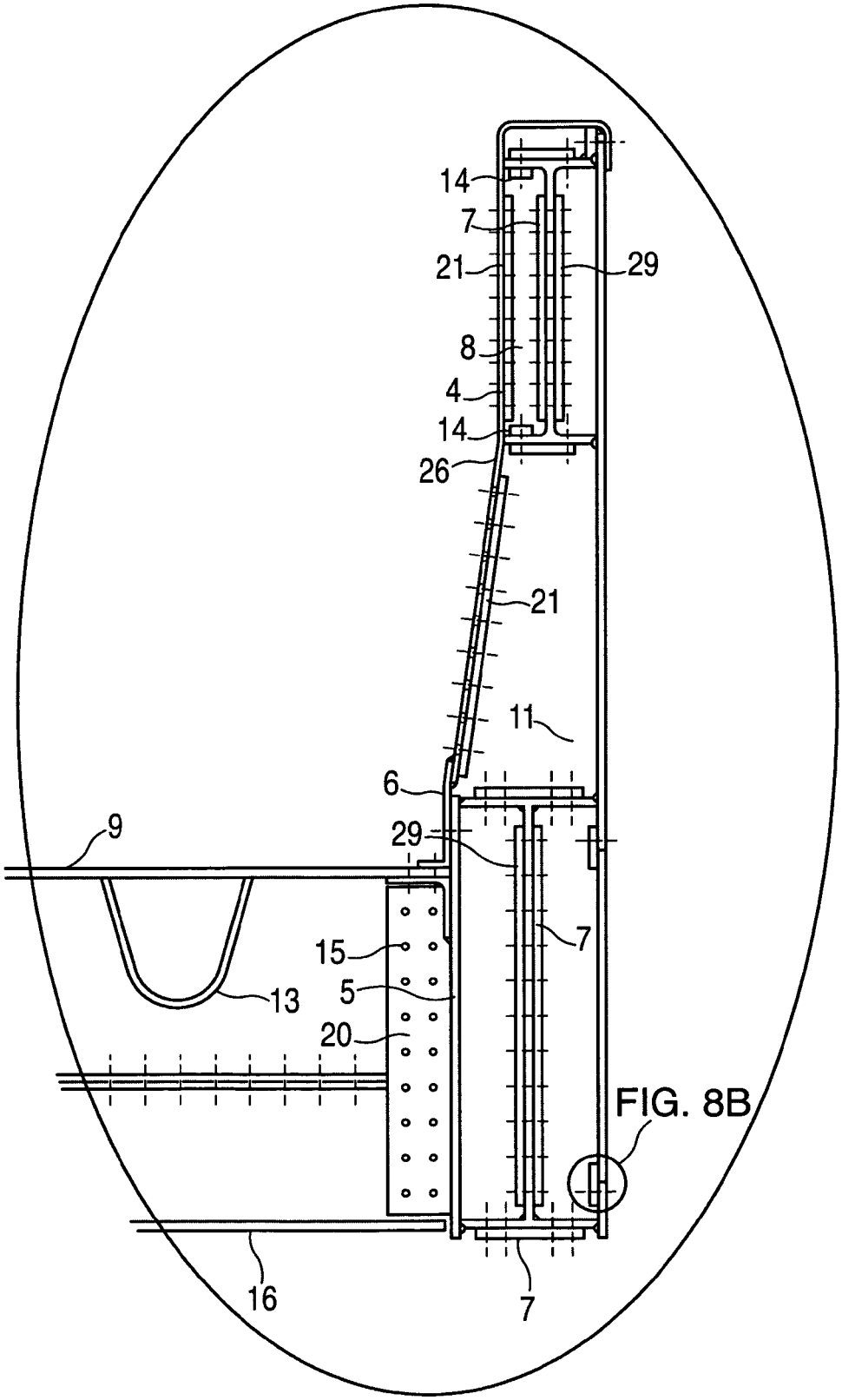
FIG. 9A is a cross sectional view of the assembly of FIG. 9.

FIG. 9A is a cross sectional view of the assembly of FIG. 9.

Figure 10:
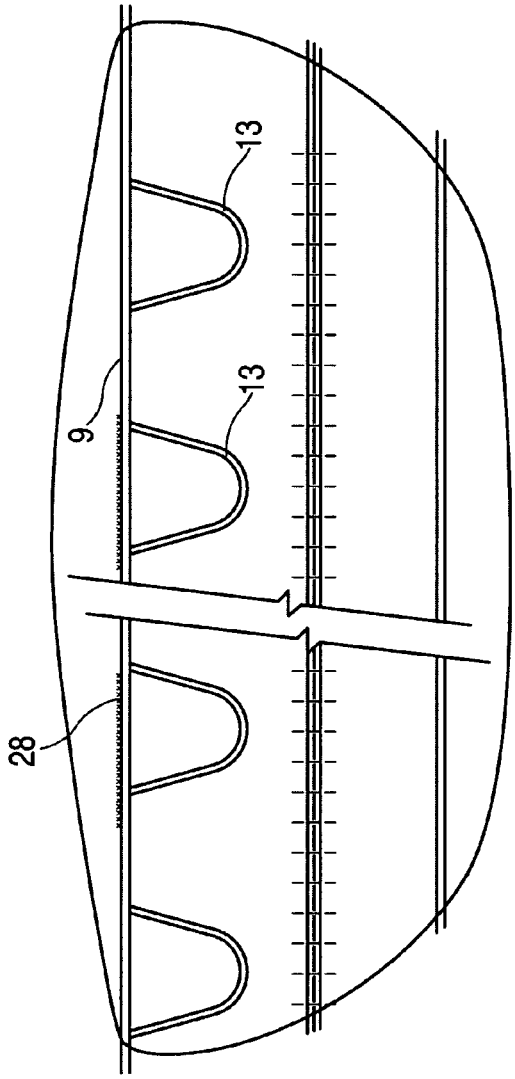
FIG. 10, shown in the detail viewing ellipse of FIG. 1, is a cross sectional view of the orthotropic deck panel and its attachment to the crossbeam.

FIG. 10 is a cross sectional view of the orthotropic deck panel attached to the cross beam 16 and to the box girder corner angle 17 and to the lower web stiffener extensions 20 of FIG. 9. The crossbeam 16 and deck diaphragms 10 with appropriate fasteners 18 are used to complete this assembly.

FIG. 11 is a combined perspective view of all of the FIGS. 1 through 10, illustrating the referenced bridge and the manner in which they are assembled to produce the desired structure, with a cutaway view of the side box girder elements showing the arrangement of these interior elements and the orthotropic deck plate 9 with the attached ribs 13 and diaphragm 10.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

NUMERICAL LIST OF THE ELEMENTS OF THE INVENTION

1. Lower chord beam
2. Upper chord beam
3. Outer back plate of side girder
4. Inner girder cover plate
5. Inner lower chord cover plate
6. Stainless steel snowplow protection angle
7. Upper and lower chord splice plates
8. Web stiffener plates
9. Bridge orthotropic deck plate
10. Orthotropic deck crossbeam diaphragm
11. Box girder diaphragms
12. Orthotropic deck support angle
13. Orthotropic deck support ribs
14. ¾" thick tapped bar
15. Holes for fastener bolts
16. Crossbeams
17. Crossbeam knife connection angles
18. Appropriate connection fasteners
19. Detail of plug weld in slot
20. Lower chord beam web stiffener extensions
21. Tapped splice bar welded to inside edge of diaphragm or box girder cover plate
22. Splice plate access bolting opening
23. Splice plate bolting opening cover plate
24. Tapped edge bar of cover plate
25. Sloped cement-like material with anchors to exposed flanges
26. Upper inner box girder access cover plate
27. Plug weld backup bar welded to inside edge of diaphragm 11
28. Textured riding surface
29. Internal tapped splice plate welded to upper and lower chord beam webs or diaphragm

We claim:

1. A bridge structure having an assembly of structural elements, said structural elements acting together to provide a bridge structure of high strength and durability; said bridge structure comprising:

at least two box girders comprised of a pair of left and right side box girders, each having respective upper and lower girder chords connected together by side plates and diaphragms to form a boxed girder assembly with a respective upper portion having a partially sloped section acting as a highway barrier;

each said box girder forming a barrier structure;

deck support beams being attached between said lower chords of said at least two girders supporting a respective orthotropic deck panel, said orthotropic deck panel being fastened to respective tops of said deck support beams, said orthotropic deck panel forming a bridge deck made of at least one surface plate supported by longitudinal ribs underneath; said orthotropic deck panel being attached directly to respective lower vertically extending portions of said partially sloped sections of said at least two box girders, said orthotropic deck panel being connected to the vertically extending portion of each of said box girders below said partially sloped section thereof, whereby said left and right side box girders have relatively smooth walls facing said orthotropic deck panels, said orthotropic deck panels providing a riding surface of the bridge and serving as a horizontal diaphragm accommodating horizontal forces to which the bridge is subjected;

wherein said longitudinal ribs supporting said orthotropic panel comprise undulating arcuate ribs;

said bridge structure having projecting corner angle members with one leg attached to said orthotropic panel and an adjacent leg extending up along the vertical portion of each side girder and past where said sloping section begins.

2. A bridge structure as in claim 1 further comprising side box girder assemblies being made of shorter segments, and said shortened segments being field bolted together with splice plates, thereby simplifying transportation and field assembly of said bridge structure.

3. A bridge structure as in claim 1 further comprising splice plates being accessible for bolting via openings in a surface of each said box girder, said openings closable with respective bolted cover plates.

4. A bridge structure as in claim 3 further comprising removable upper inside cover plates of said box girder assembly; said removable upper inside cover plates providing an access for the joining of respective shorter segments of said side box girder assemblies into predetermined lengths forming said bridge structure.

5. A bridge structure as in claim 4 further comprising an inside splice cover panel with holes for providing access for bolting respective splices of said upper and lower chord beams of said side box girder.

6. A bridge structure as in claim 1 further comprising temporary textured riding surfaces being provided on said bridge deck surfaces to prevent skidding of vehicles using the bridge, said applied temporary textured riding surfaces forming a base for a permanent macadam riding surface applied in the field.

7. A bridge structure as in claim 1 further comprising side barriers of said side box girders including an upper chord beam, a lower chord beam, an inner girder cover plate, an outer back plate, and diaphragms between said upper chord beam and said lower chord beam.

8. A bridge as in claim 1 further comprising an inner girder cover plate of said box girder being attached to respective diaphragms of said side box girders by plug welding a backup bar of respective diaphragms into matching slots cut into a respective face of said inner girder cover plates or by bolting to a tapped bar welded to an edge of said diaphragm through matching holes drilled into a respective face of said inner girder cover plate.

9. The bridge assembly as in claim 1, wherein said bridge assembly comprises metal.

10. The bridge assembly as in claim 1 wherein the metal is selected from the group consisting of steel, carbon steel ,stainless steel and aluminum.

11. A bridge structure having an assembly of structural elements, said structural elements acting together to provide a structure of high strength and durability said bridge structure comprising:

at least two box girders composed of a pair of left and right side box girders, each having respective upper and lower girder chords connected together by side plates and diaphragms to form a boxed girder with a respective upper portion shaped like a partially sloped highway barrier;

each said side box girder forming a side barrier;

deck support cross beams being attached between said lower girder chords of said at least one girder supporting a respective orthotropic deck panel, said orthotropic deck panel being fastened to respective tops of said cross beams, said orthotropic deck panel forming a bridge deck made of at least one surface plate supported by longitudinal ribs underneath; said orthotropic deck panel being attached to respective lower portions of barrier shaped inner panels of said left and right side box girders, said orthotropic deck panel providing a riding surface of the bridge and said orthotropic deck panel serving as a horizontal diaphragm accommodating horizontal forces to which said bridge structure is subjected, wherein respective supporting composite box girder structures of said box girder comprise side barriers preventing vehicles and pedestrians from falling off the side of the bridge structure, wherein said side barriers forming the upper portion of said box girders support said orthotropic deck panel, said orthotropic deck panel being attached to sides of said composite box girder structure to eliminate lateral movement of the box girder structure, and said orthotropic deck panel and supporting said longitudinal ribs having a transverse diaphragm attached to respective extensions of respective lower side beam web stiffeners protruding through respective slots in respective lower inner side beam cover plates of each said side box girder, by bolting through respective matching holes.

12. A bridge structure as in claim 11 further comprising a respective transverse diaphragm of said bridge deck surface plate being attachable to a beam of a plurality of beams attached to a respective extension of said lower portion of said side beams' web stiffeners and to a respective diaphragm, said bridge structure carrying the weight of additional deck plate assemblies, said bridge structure providing additional lanes of vehicular traffic using said bridge structure.

13. A bridge as in claim 12 further comprising a connection angle with holes matching those in a lower chord beam web stiffener extension being bolted to an inner lower chord web plate to create a knife connection for said cross beam and a respective orthotropic deck crossbeam diaphragm.

14. A bridge structure as in claim 11 further comprising a layer of epoxy concrete forming a slope on all protruding flanges and horizontal surfaces of the underside of said bridge structure, isolating said bridge structure from nesting and congregating birds to eliminate corrosion caused by bird excrement.

15. A bridge structure having an assembly of structural elements, said structural elements acting together to provide a structure of high strength and durability; said bridge structure comprising:

at least two box girders composed of a pair of left and right side box girders, each having respective upper and lower girder chords connected together by side plates and diaphragms to form a boxed girder with a respective upper portion shaped like a partially sloped highway barrier;

each said box girder forming a side barrier, the upper portion forming a side barrier and the lower portion forming deck support cross beams;

said deck support cross beams being attached between said lower girder chords of said at least two girders supporting a respective orthotropic deck panel, said orthotropic deck panel being fastened to respective tops of said deck support cross beams, said orthotropic deck panel forming a bridge deck made of at least one surface plate supported by longitudinal ribs underneath; said orthotropic deck panel being attached to respective lower portions of said barrier shaped inner panels of said at least two box girders, said orthotropic deck panel providing a riding surface of the bridge and serving as a horizontal diaphragm accommodating the horizontal forces to which the bridge is subjected, wherein respective supporting composite box girder structures of said box girder forming the side barriers prevent vehicles and pedestrians from falling off the side of the bridge structure, wherein the side barriers form the upper portion of said box girder supporting said orthotropic deck panel, said orthotropic deck panel being attached to sides of said composite box girder structure to eliminate lateral movement of the side box girder structure, and said orthotropic deck panel being supported by and bolted to an angle attached to an inner web plate of a lower beam of each side box girder and to a stiffener extension of said lower chord, said connected orthotropic deck panel, angle, inner web plate and stiffener extension forming a knife connection for greater strength.

16. A bridge structure having an assembly of structural elements, said structural elements acting together to provide a structure of the high strength and durability; said bridge structure comprising:

at least two box girders each composed of a pair of left and right side box girders, each having respective upper and lower girder chords connected together by side plates and diaphragms to form a boxed girder with a respective upper portion shaped like a partially sloped highway barrier;

each said box girders forming a side barrier;

deck support cross beams being attached between said lower chords of said at least two girders supporting a respective orthotropic deck panel, said orthotropic deck panel being fastened to respective upper portions of said deck support cross beams, said orthotropic deck panel forming a bridge deck made of at least one surface plate supported by longitudinal ribs underneath; said orthotropic deck panel being attached to respective lower portions of said barrier shaped inner panels of said at least two box girders, said orthotropic deck panel providing a riding surface of the bridge and serving as a horizontal diaphragm accommodating the horizontal forces to which the bridge is subjected, wherein respective supporting composite box girder structures of said box girder forming the side barriers prevent vehicles and pedestrians from falling off the side of the bridge structure, wherein the side barriers form the upper portion of said side box girders that supports said orthotropic deck panel, said orthotropic deck panel being attached to sides of said composite box girder structure to eliminate lateral movement of the side box girder structure, and wherein an angle formed by said bridge deck surface plate and an upper inner cover plate is a stainless steel angle reinforcing said area formed by said bridge deck surface plate and said upper inner cover plate; said stainless steel angle limiting corrosion and loss of paint that occurs when snow plows and other equipment contact said bridge deck surface plate and said upper inner cover plate of said bridge structure.

17. The bridge as in claim 16 wherein the metal is selected from the group consisting of steel, carbon steel, stainless steel and aluminum.

* * * * *